United States Patent [19]

Stapp

[11] 4,405,567

[45] Sep. 20, 1983

[54] URANIUM VALUE LEACHING WITH AMMONIUM CARBONATE AND/OR BICARBONATE PLUS NITRATE OXIDANT AND OPTIONALLY OXIDATION-CATALYTIC METAL COMPOUNDS

[75] Inventor: Paul R. Stapp, Bartlesville, Okla.

[73] Assignee: Phillips Petroleum Company, Bartlesville, Okla.

[21] Appl. No.: 208,717

[22] Filed: Nov. 20, 1980

[51] Int. Cl.[3] ..... C22B 60/02

[52] U.S. Cl. ..... 423/17; 423/3

[58] Field of Search ..... 423/3, 15, 17; 299/4, 299/5

[56] References Cited

U.S. PATENT DOCUMENTS

| | | | |
|---|---|---|---|
| 3,036,881 | 5/1962 | Clifford | 423/3 |
| 3,792,903 | 2/1974 | Rhoades | 423/17 X |
| 3,860,289 | 1/1975 | Learmont | 423/17 X |

OTHER PUBLICATIONS

Merritt, Robert C. "The Extractive Metallurgy of Uranium" Colorado School of Mines Research Institute 1971, pp. 83–84, 98–112.

*Primary Examiner*—Deborah L. Kyle
*Assistant Examiner*—Matthew A. Thexton

[57] ABSTRACT

In accordance with the present invention, uranium values are extracted from solid materials containing uranium in lower valence states than its hexavalent state comprising contacting the solid materials containing uranium with an alkaline leach solution containing the ionic species $NH_4^+$ and $NO_3^-$ in an amount sufficient to convert at least a portion of the uranium in valence states lower than its hexavalent state to its hexavalent state. In another embodiment of the present invention, the aqueous alkaline leach solution is an aqueous solution of a carbonate selected from the group consisting of ammonium carbonate, ammonium bicarbonate and mixtures thereof. In a further embodiment, ionic species $NO_3^{31}$ is supplied by an alkaline nitrate. In yet another embodiment of the present invention, the aqueous alkaline leach solution additionally contains at least one catalytic compound of a metal selected from the group consisting of copper, cobalt iron nickel, chromium and mixtures thereof adapted to assure the presence of the ionic species $Cu^{++}$, $Co^{++}$, $Fe^{+++}$, $Ni^{++}$, $Cr^{+++}$ and mixtures thereof, respectively, is present during the contacting of the solid materials containing uranium with the aqueous alkaline leach solution in an amount sufficient to catalyze the oxidation of at least a part of the uranium in valence states lower than its hexavalent state to its hexavalent state.

19 Claims, 2 Drawing Figures

URANIUM VALUE LEACHING WITH AMMONIUM CARBONATE AND/OR BICARBONATE PLUS NITRATE OXIDANT AND OPTIONALLY OXIDATION-CATALYTIC METAL COMPOUNDS

BACKGROUND OF THE INVENTION

The present invention relates to the extraction of uranium values from uranium-containing materials. In a more specific aspect, the present invention relates to the extraction of uranium values from uranium-containing materials by the use of a leaching solution. Still more specifically, the present invention relates to the extraction of uranium values from mined ores or in situ from subsurface formations by the use of an aqueous alkaline leach solution containing an oxidant and, optionally, a catalytic material.

The importance of uranium as a source of energy is well established. Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vandium, gold and the like, can be simultaneously recovered. However, in most cases, concentrations of the latter materials are too low to improve the economics to any great extent and techniques for recovering the uranium often are not well adapted to the recovery of other valuable minerals.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as, limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a pregnant solution, is produced through at least one production well penetrating the deposit.

The most common aqueous leach solutions are either aqueous acidic solutions, such as sulfuric acid solutions, or aqueous alkaline solutions, such as sodium carbonate and/or bicarbonate.

While aqueous acidic solutions are normally quite effective in the extraction of uranium values and act quite rapidly in the extraction of the uranium values, the volumes of acid consumed are usually quite high, thus making the use of aqueous acidic solutions relatively expensive. In addition, aqueous acidic solutions generally cannot be utilized to extract uranium values from ores or in situ from deposits containing high concentrations of acid-consuming gangue, such as limestone. On the other hand, aqueous alkaline leach solutions are either not as effective in the extraction of uranium values and/or extract the uranium values at a rate which is too slow to be economically justified.

The uranium values are conventionally recovered from acidic leach solutions by techniques well known in the mining art, such as direct precipitation, selective ion exchange, liquid extraction, etc. Similarly, pregnant alkaline leach solutions may be treated to recover the uranium values by contact with ion exchange resins, precipitation, as by adding sodium hydroxide to increase the pH of the solution to about 12, etc.

As described to this point the extraction of uranium values is dependent strictly upon the economics of mining versus in situ extraction and the relative costs of acidic leach solutions versus alkaline leach solutions. However, this is an oversimplification, to the extent that only uranium in its hexavalent state can be extracted in either acidic or alkaline leach solutions. While some uranium in its hexavalent state is present in mined ores and subterranean deposits, the vast majority of the uranium is present in its valence states lower than the hexavalent state. For example, uranium minerals are generally present in the form of uraninite, a natural oxide of uranium in a variety of forms such $UO_2$, $UO_3$, $UO.U_2O_3$ and mixed $U_3O_8$ ($UO_2.2UO_3$), the most prevalent variety of which is pitchblende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from mined ores and subsurface deposits with aqueous acidic or aqueous alkaline leach solutions, it is necessary to oxidize the lower valence states of uranium to the soluble, hexavalent state. It has heretofore been suggested that air, oxygen and other known oxidants be added to the leach solution in order to accomplish the oxidation of the uranium to its hexavalent state. Obviously, a major factor in the utilization of oxidants in leach solutions is the cost of the oxidant itself. While air would appear to be the least expensive oxidant to utilize, certain difficulties are encountered, to the extent that insufficient air can be dissolved in the leach solution at atmospheric pressure thereby rendering the extraction process rather inefficient. While adding air to the leach solution under pressure will obviously incease the volume of air available for oxidation and improve the ultimate recovery of uranium values and the rate of recovery, the compression equipment necessary, for example, to add air under pressures of about 1000 to 2000 psi or higher for ore leaching or in situ extraction, necessarily adds to the cost of the operation. Of the other known oxidants which have been suggested in the prior art, the oxidant itself becomes a major cost factor. For example, stoichiometric quantities of most of the prior art oxidants range anywhere from about 10 to 80 pounds or more of oxidant per ton of ore treated. However, even aside from cost, the utilization of oxidants in leach solutions has a number of other drawbacks. For example, the relative effectiveness of various known oxidants varies widely. Further, a number of known oxidants are unstable, decompose, are otherwise lost during use, or lose their effectiveness for one reason or another. Finally, there appears to be no certain way of predicting what materials will act as oxidants in combination with which leach solution. For example, certain oxidants useful in aqueous acidic solutions are not useful in aqueous alkaline solutions, certain oxidants which are effective with certain acids, forming an aqueous acid solution, are not effective with other acids and certain oxidants effective with certain alkaline materials, making up an alkaline leach solution, are not effective with other alkaline materials.

In order to reduce the quantity of oxidant necessary, increase the ultimate effectiveness of the oxidants and/or increase the rate of extraction of the uranium values, it has been suggested that catalytic amounts of certain materials be added to alkaline leach solutions containing oxidants. Some of these catalytic materials are themselves oxidants when utilized in stoichiometric quantities but also act as catalysts when utilized in catalytic quantities well below stoichiometric amounts. In most cases the catalytic materials are materials adapted to supply ions of metals capable of existing in high and low valence states. The latter has led to the theory that the catalyst enters into a redox reaction in which the oxidant of the leach solution oxidizes the metal ion to its higher valence state, the metal ion in its higher valence state oxidizes the uranium and is thereby itself reduced in valence and the cycle continues with the oxidant oxidizing the catalytic ion to its higher valence state, etc. Several other theories have also been advanced to explain why a particular catalytic material or group of catalytic materials functions as a catalyst. However, none of the theories concerning the role of the catalytic materials appears to be applicable to all catalytic materials which have been found effective. Consequently, there appears to be no basis for predicting a particular material will be effective as a catalyst in an alkaline leach solution containing an oxidant. In addition, the utilization of catalytic materials is fraught with the same uncertainties as the utilization of oxidants. Specifically, materials which should be effective as catalysts in accordance with a particular theory are often ineffective, unstable in the leach solution or ineffective in combination with a particular alkaline material, a particular oxidant or a combination of a particular alkaline material and a particular oxidant.

SUMMARY OF THE INVENTION

It is therefore an object of the present invention to provide an improved method for extracting uranium values from materials containing uranium which overcomes the above mentioned problems of the prior art.

Another object of the present invention is to provide an improved method for extracting uranium values from materials containing uranium in valence states lower than its hexavalent state.

Another and further object of the present invention is to provide an improved method for extracting uranium values from materials containing uranium in valence states lower than its hexavalent state in which the rate of extraction is substantially improved.

Yet another object of the present invention is to provide an improved method for extracting uranium values from materials containing uranium to valence states lower than its hexavalent state in which a significant amount of uranium in valence states lower than its hexavalent state converted to the hexavalent state is significantly increased.

A still further object of the present invention is to provide an improved method for extracting uranium values from materials containing uranium in valence states lower than its hexavalent state in which the rate of oxidation of the uranium in valence states lower than its hexavalent state to the hexavalent state is significantly increased.

Another and further object of the present invention is to provide an improved method for extracting uranium values from materials containing uranium utilizing a highly effective alkaline leach solution.

Another object of the present invention is to provide an improved method for extracting uranium values from materials containing uranium in valence states lower than its hexavalent state in which the uranium in valence states lower than its hexavalent state is effectively and rapidly oxidized to the hexavalent state with a highly effective alkaline leach solution containing an oxidant.

A further object of the present invention is to provide an improved method for extracting uranium values from materials containing uranium in valence states lower than its hexavalent state which effectively and rapidly converts the uranium in its lower valence states to its hexavalent state with an effective combination of an alkaline solution containing an oxidant and a catalytic material which improves the effectiveness and the rate of oxidation by the oxidant.

Still another object of the present invention is to provide an improved method for extracting uranium values from materials containing uranium utilizing an alkaline leach solution having a substantially reduced consumption of the chemicals making up the leach solution.

In accordance with the present invention, uranium values are extracted from solid materials containing uranium in lower valence states than its hexavalent state by contacting the solid materials containing uranium with an alkaline leach solution containing the ionic species $NH_4^+$ and $NO_3^-$ in an amount sufficient to convert at least a portion of the uranium in valence states lower than its hexavalent state to its hexavalent state. In another embodiment of the present invention, the aqueous alkaline leach solution is an aqueous solution of a carbonate selected from the group consisting of ammonium carbonate, ammonium bicarbonate and mixtures thereof. In a further embodiment, the ionic species $NO_3^-$ is supplied by an alkaline nitrate, such as ammonium, alkali metal and alkaline earth metal nitrates. In yet another embodiment of the present invention, the aqueous alkaline leach solution additionally contains at least one catalytic compound of a metal selected from the group consisting of copper, cobalt, iron, nickel, chromium and mixtures thereof adapted to assure the presence of the ionic species $Cu^{++}$, $Co^{++}$, $Fe^{+++}$, $Ni^{++}$, $Cr^{+++}$ and mixtures thereof, respectively, during the contacting of the solid materials containing uranium with the aqueous alkaline leach solution in an amount sufficient to catalyze the oxidation of at least a part of the uranium in valence states lower than its hexavalent state to its hexavalent state.

PREFERRED EMBODIMENTS

Figure 1:
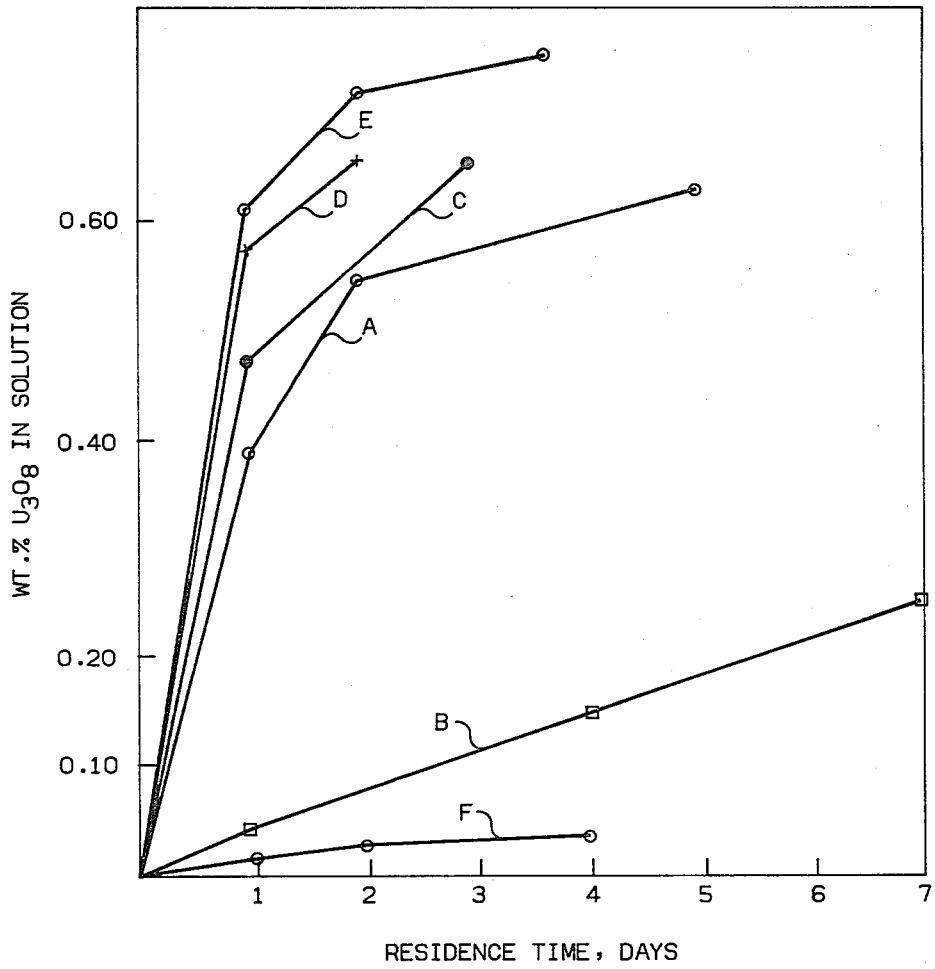
FIG. 1 is a plot of the rate of uranium solubilization with various leach solutions, including those of the present invention.

When the term "alkaline" is utilized in the present application and in the claims, this term is meant to include salts having an alkali metal, an alkaline earth metal or ammonium as a cation.

As previously pointed out in the discussion of the background of the invention, aqueous alkaline leach solutions for the extraction of uranium values from mined ores containing uranium and from subsurface uranium deposits, by in situ extraction, generally contain an oxidant to oxidize the uranium in valence states lower than the hexavalent state to the soluble, hexavalent state. The aqueous alkaline leach solution is usually made up of an alkaline carbonate such as sodium carbonate and conventional oxidants, include air, oxygen and hydrogen peroxide.

It has been discovered in accordance with the present invention that aqueous alkaline leach solutions containing the ionic species $NH_4^+$ and $NO_3^-$ are significantly more effective than such prior art aqueous alkaline leach solutions. While it is not intended that the invention be based on any specific theory, it is believed that the ionic species $NH_4^+$ and $NO_3^-$ act as oxidants. The ionic species $NH_4^+$ may be supplied by the addition of ammonium hydroxide or ammonia gas to the aqueous alkaline leach solution or, in accordance with a further embodiment of the present invention, by the utilization of a compound containing the ionic species $NH_4^+$ to make up the aqueous alkaline leach solution, particularly compounds selected from the group consisting of ammonium carbonate, ammonium bicarbonate and mixtures thereof. The use of the ammonium carbonates has been found to further substantially improve the effectiveness of the aqueous alkaline leach solution. The ionic species $NO_3^-$ is most conveniently supplied by the addition to the aqueous alkaline leach solution of an alkaline nitrate such as sodium nitrate, ammonium nitrate, etc., in amounts sufficient to convert the uranium in valence states lower than its hexavalent state to the hexavalent state.

As pointed out in the background discussion, it is also suggested in the prior art that catalytic amounts, well below the amounts needed as an oxidant, of a catalytic material can be added to an aqueous alkaline leach solution to improve the effectiveness of the oxidant. Numerous theories have been advanced for the operation of catalytic materials in aqueous alkaline leach solutions. However, none of these theories permit one to predict what particular catalytic materials can be utilized. For example, ceratin materials have been suggested as catalysts which will act as an oxidant for converting uranium in valence states lower than its hexavalent state to the hexavalent state if utilized in stoichiometric or higher than stoichiometric quantities. However, all materials heretofore suggested as oxidants for aqueous alkaline leach solutions do not, in fact, act as catalytic materials in conjunction with other oxidants. It has also been suggested that the catalytic material enters into a redox reaction in which the oxidant of the leach solution oxidizes the cation of the catalytic material to a higher valence state, the catalytic material then oxidizes the uranium to a higher valence state and is itself reduced, and the cycle is repeated with the oxidant again oxidizing the catalytic material cation to its higher valence state. However, all materials which are capable of entering into a redox reaction do not act catalytically in combination with conventional oxidants in aqueous alkaline leach solutions and it has been found that a redox reaction does not in fact occur. Implicit in the latter theory is that the cation of the catalytic material should be added in its higher valence state or be converted to its higher valence state when added to the alkaline leach solution. It has been found that certain multivalent materials can be utilized in their lower valence state and are effective as catalysts even though they remain in their lower valence state in the alkaline leach solution. A perusal of catalytic materials suggested for use in aqueous alkaline leach solutions would also appear to suggest that the catalytic material be a metal compound of a transition metal. However, all transition metals do not in fact act catalytically and all such transition metals which do have a catalytic effect do not exhibit comparable catalytic effects. The sum and substance of the above, and other factors not specifically mentioned, thus makes it impossible to predict what catalytic material will work best in combination with a particular alkaline lixivant, in combination with a particular oxidant or in combination with a particular lixiviant and a particular oxidant.

In accordance with the present invention, it has been found that the extraction of uranium values from solid materials containing uranium can be still further improved by adding to an aqueous leach solution, containing the ionic species $NH_4^+$ and $NO_3^-$, a catalytic material of at least one metal selected from the group consisting of copper, cobalt, iron, nickel, chromium and mixtures thereof adapted to assure the presence of the ionic species $Cu^{++}$, $Co^{++}$, $Fe^{+++}$, $Ni^{++}$, $Cr^{+++}$ and mixtures thereof, respectively, during the contacting of the solid materials containing uranium with the alkaline leach solution and in an amount sufficient to catalyze the oxidation of at least a portion of the uranium in valence states lower than the hexavalent state to the hexavalent state. Preferably, the metal of the metallic compound is capable of forming coordination compounds in an alkaline solution, particularly with the ionic species $NH_4^+$ or the $NH_3$ compound. It has still further been found, in accordance with the present invention, that further improved results can be obtained by substituting air or oxygen for a part of the alkaline nitrate or adding oxygen or air to normal amounts of the alkaline nitrate. In the latter instance, the rate of oxidation of uranium in valence states lower than the hexavalent state to the hexavalent state is significantly improved. It appears, however, that an excess of oxygen or air reduces the effectiveness of the leach solution. Specifically, it appears that best results are obtained if the aqueous alkaline solution is saturated with air at atmospheric pressure, but when an excess of air above this amount is dissolved, as by sparging air through the aqueous alkaline solution, the effectiveness and the rate of conversion of uranium in valence states lower than the hexavalent state to the hexavalent state are significantly reduced.

The following examples illustrate the nature of and the advantages of the present invention.

Since leaching tests conducted on actual ore samples usually give anomalous results, due in part to differences among samples, even from the same deposit, and possible complicating effects of metals other than uranium and other components in the samples, it has become common practice in the art to conduct leach tests utilizing substantially pure insoluble uranium dioxide. The use of uranium dioxide is justified on the basis that it is the actual compound present in part in uraninite and is typical of the oxidation state of other uranium containing ores, such as coffinite. While the results obtained by solubilizing uranium dioxide will not be comparable in numerical value to what one would obtain if the uranium containing solids themselves were utilized, such tests are useful in comparing the effectiveness of leach solutions and the rate of solubilization of uranium in such solutions. Obviously also, to the extent that a particular leach solution is ineffective or relatively ineffective in solubilizing uranium dioxide, it will clearly be ineffective in the extraction of uranium from solid materials containing uranium.

In all of the following examples the experiments were conducted at ambient temperature in magnetically stirred Erlenmeyer flasks which, unless otherwise noted, were loosely stoppered with rubber stoppers. The chemicals utilized in the leach solutions were dissolved in distilled water and the insoluble uranium dioxide was added. In all cases a total of 200 grams of leach solution was utilized and 1.35 g of uranium dioxide was utilized. Complete solution of this amount of uranium dioxide would give 0.701 weight percent $U_3O_8$. In order to determine the rate of solubilization, as reported hereinafter, for the experiments, the contents of the flasks were stirred for the times indicated, intervally the stirrers were turned off one hour to allow unreacted $UO_2$ to settle and aliquots of solution were removed by pipette, filtered through a medium porosity fritted funnel and analyzed for soluble uranium.

EXAMPLE I

In this series of tests the specified amounts of chemicals, expressed in weight percent, were utilized.

TABLE

| | Lixivant | Additive | Catalyst |
|---|---|---|---|
| A | 2.0% $NH_4HCO_3$ | 0.5% $NaClO_3$ | 0.1% $CuSO_4.5H_2O$ |
| B | 2.0% $NH_4HCO_3$ | 0.5% $NH_4NO_3$ | — |
| C | 2.0% $(NH_4)_2CO_3$ | 0.5% $NH_4NO_3$ | 0.1% $CuSO_4.5H_2O$ |
| D | 2.0% $NH_4HCO_3$ | 0.5% $NH_4NO_3$ | 0.1% $CuSO_4.5H_2O$ |
| E | 2.0% $(NH_4)_2CO_3$ | 1.0% $NaNO_3$ | 0.1% $CuSO_4.5H_2O$ |
| F | 2.0% $Na_2CO_3$ | 1.0% $NaNO_3$ | 0.1% $CuSO_4.5H_2O$ |

The results of this series of tests are plotted in FIG. 1 as weight percent $U_3O_8$ in solution versus residence time in days to show the comparative rates of solubilization of the uranium dioxide. The letter designations of the curves correspond to the letter designations for the leach solutions as set forth in the above table.

It had been found by applicant, in previous work, that an alkaline chlorate, such as sodium chlorate, was a very effective oxidant for aqueous alkaline solutions, particularly in solutions utilizing ammonium carbonate and/or bicarbonate as a lixiviant and catalytic amounts of a metal selected from the group consisting of copper cobalt, iron, nickel, chromium and mixtures thereof, particularly copper. Accordingly, the best combination of these ingredients, as previously established, was utilized as a basis for comparison in the present series of tests. The results of a test, utilizing ammonium bicarbonate as a lixiviant, sodium chlorate as an additive and copper sulfate as a catalytic material, is shown by curve A of FIG. 1. Curve B of FIG. 1, utilizing ammonium bicarbonate as a lixiviant, ammonium nitrate as an additive and no catalytic material, illustrates that ammonium nitrate will oxidize uranium in valence states lower than the hexavalent state to the hexavalent state. However, it is to be observed from FIG. 1 that leach solution B solubilizes uranium at a relatively low rate. Consequently, for most commercial purposes this rate would not be practical. By comparison, however, curve C and D of FIG. 1 show that the utilization of small amounts of copper sulfate as a catalytic material very substantially increases the solubilization of low valence state uranium as compared with the parallel run in which no catalytic material was utilized. In fact, the particular combination of ammonium carbonate or bicarbonate, as a lixiviant, ammonium nitrate, as an additive, and a catalytic material significantly improved the rate of uranium solubilization over what had previously been found to be the best aqueous alkaline leach solution, utilizing an alkaline chlorate as an additive. In this series of tests it was also found that substituting sodium nitrate for ammonium nitrate as an additive produced comparable results. This is shown by curve E of FIG. 1. However, when an equivalent solution prepared with sodium carbonate as a lixiviant, rather than ammonium bicarbonate, an extremely poor rate of solubilization of uranium was obtained as shown by curve F of FIG. 1. In fact, the combination of sodium carbonate, sodium nitrate and copper sulfate was substantially inferior to the combination of ammonium bicarbonate, ammonium nitrate and no catalyst. Parallel tests utilizing ammonium carbonates as a lixiviant, ammonium nitrate as an additive, and 0.5 weight percent cobalt sulfate and potassium ferricyanide, respectively, as catalytic materials, produced greatly reduced rates of solubilization of uranium as compared with the solutions containing ammonium carbonate, ammonium nitrate and copper, as a catalyst. It was also found that equivalent amounts of ammonium nitrate and copper nitrate, without a carbonate or bicarbonate as a lixiviant, resulted in essentially no solubilization of uranium.

EXAMPLE II

Figure 2:
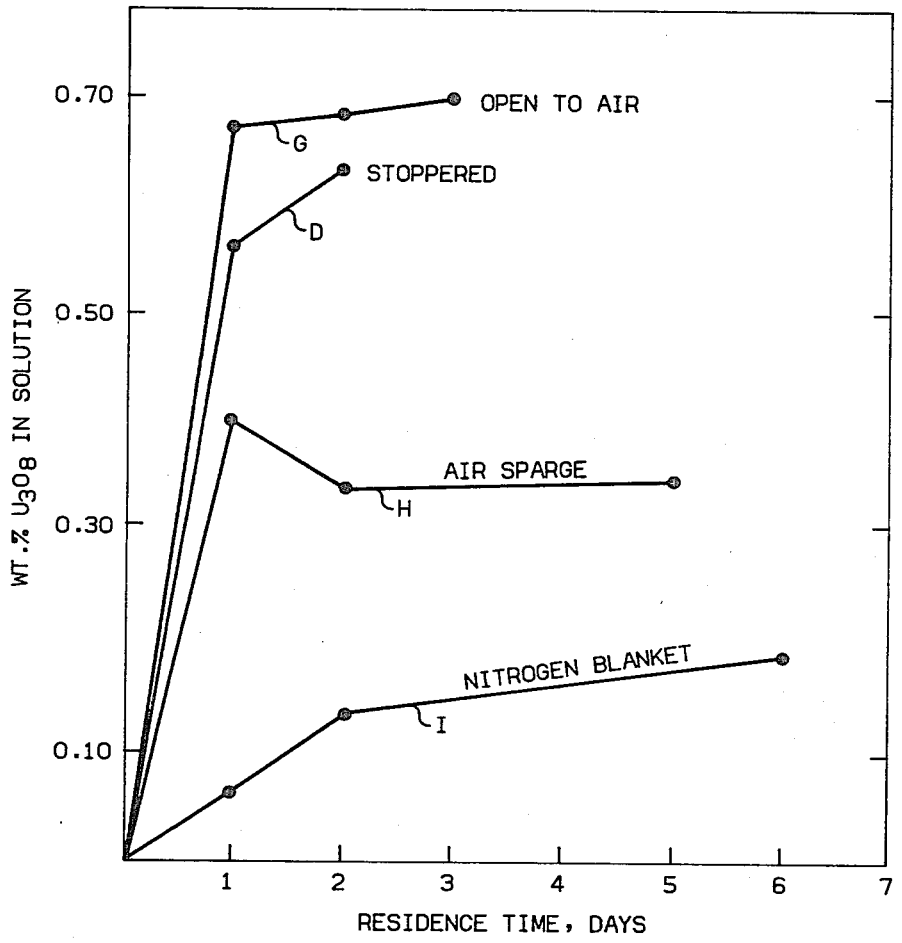
FIG. 2 is a plot of the rate of uranium solubilization showing the effect of air on the solutions of the present invention.

This series of tests shows that the use of an oxidizing gas, specifically air, as an additional oxidant in the aqueous alkaline leach solutions of the present invention is highly desirable. Curve D of FIG. 1 of the drawings was used as a basis for comparison. In this run, as shown in Example I, the aqueous leach solution was made up of 2 weight percent ammonium bicarbonate, 0.5 weight percent ammonium nitrate and 0.1 weight percent copper sulfate and the Erlenmeyer flask was lightly stoppered. Under these conditions, the solution would normally contain sufficient oxygen to oxidize at least a part of the low valence state insoluble uranium. However, as shown by curve G of FIG. 2, some improvement was obtained in the rate of uranium solubilization by conducting the experiment with the solution open to the air at atmospheric pressure. By contrast, when air was sparged continuously through the leach solution, only about one third of the uranium was dissolved the first day and no further uranium was dissolved in four additional days (curve H). Analysis of a sample of the leach solution appeared to indicate that continuous sparging of the solution reduced the bicarbonate concentration to such a level that only limited uranium solubility could occur. Consequently, it appears that the best results are obtained by simply exposing the leach solution to air, for example, when mixing the chemicals into the solution or during the regeneration of used solution for reuse. In any event, a concerted effort to dissolve large amounts of air is undesirable. As a further comparison, a leach run was carried out under a nitrogen blanket so that the solution contained only traces of air introduced during handling of the solution. The results of this run are shown as curve I of FIG. 2. Comparison of FIGS. 1 and 2 indicate that solubilization of insoluble uranium, under a nitrogen blanket, was approximately equivalent to the run shown in curve B of FIG. 1 where ammonium bicarbonate was utilized as a lixiviant, ammonium nitrate as an additive and no catalyst. Accordingly, a concerted effort to exclude air from the solution should not be undertaken. In order to determine whether the air as opposed to the ammonium nitrate was acting as an oxidant, extended tests were carried out in the same manner as the last test utilizing a nitrogen blanket but for two-week periods. In these instances, 0.40 weight percent of uranium was solubilized. This amount of uranium could not be solubilized or oxidized by the cupric ion of the catalytic material in combination with the traces of air introduced during handling of the solution. Therefore, it appears that the alkaline nitrate does in fact act as an oxidant in accordance with the present invention.

As previously indicated, the method of the present invention is useful both in the extraction of uranium values from mined ore containing uranium, as well as in the in situ extraction of uranium from subsurface deposits containing uranium. However, the method of the present invention is particularly useful for the in situ extraction of uranium from subsurface deposits, since such extraction methods require large volumes of leach solution and the solutions utilized in accordance with the present invention are effective with very small amounts of chemicals. The method of the present invention is also particularly useful in extraction of uranium values from solid materials containing uranium and which also contain significant amounts of acid consuming gangues, such as calcium carbonate and the like.

Surface leaching of mined ore containing uranium is well known in the metallurgical art. Specifically, the ore is generally ground to increase the contact area between the uranium values in the ore and the extraction solution. Usually, the grinding is accomplished by the use of ball mills or rod mills. As previously indicated, it is customary to grind the ore to particle sizes in the vicinity of −100 mesh and in some cases −325 mesh. The finely divided ore is then disposed in equipment adapted to be heated and agitated. The extraction may be carried out at atmospheric temperature or at a temperature above atmospheric temperature up to the boiling point of water. However, a mildly elevated temperature is usually utilized since extraction is usually more effective at an elevated temperature. A heated solution containing the ground ore is then agitated for a time sufficient to extract the maximum amount of uranium values from the ore. The concentration of solids in the leach solution may vary quite widely but a workable solution usually contains between about 50 percent and 70 percent by weight of ore solids. At higher concentrations the ore leaching solution becomes too thick to be handled readily and below about 50 percent by weight of solids the volume of leach solution is too large to be economical. The contact time may also vary. In commercial practice 48 hours is usually adequate at lower temperatures with 24 hours or less at higher temperatures. At still higher temperatures and with an ore ground in very fine state the contact time may be as low as 6 hours.

The pregnant leach solution is then separated from the ore, the ore is washed with water to recover residual leach solution, usually in a countercurrent fashion, and all or part of the wash solution may be added to the leach solution for the hereinafter mentioned recycle operation. The pregnant leach solution is generally filtered to remove residual solids, treated to remove the stabilized uranium values and thereafter recycled in order to reduce the consumption of leach solution. The removal of the uranium values from the pregnant leach solution may be accomplished in various ways. For example, the uranium values may be removed by ion exchange resins. It is also conveniently removed by adding sodium hydroxide to increase the pH to about 12, at which point the uranium values precipitate to form what is known in the industry as "yellow cake." The yellow cake is then filtered from the leach solution, boiler gas from a combustion process is passed through the leach solution, the carbon dioxide being absorbed and neutralizing the caustic to thus regenerate the carbonate leach solution and lower the pH. The solution can then be recycled.

In the in situ extraction of uranium values from a subsurface deposit, the leach solution is made up in the same way as it is for the extraction of uranium values from ground ores. The leach solution is then injected into the subsurface deposit through one or more injection wells penetrating the deposit. By adjusting the pressure at which the leach solution is injected, the leach solution may be passed through the deposit continuously, by utilizing a higher injection pressure, or maintained in the deposit for a predetermined period of time, by balancing the injection pressure and the subsurface pressure and thereafter increasing the pressure to drive the pregnant leach solution from the deposit. In order to conserve leach solution, the leach solution may be driven through the reservoir or driven from the reservoir by water, gas or any other convenient driving fluid. The pregnant leach solution is then removed from the deposit through at least one production well. Appropriate patterns of injection and production wells, injection and production techniques, techniques for preventing the loss of leach solution to formations surrounding the deposit and techniques for preventing channeling of the leach solution through more porous portions of the deposit or improving the area of the deposit contacted by the leach solution are well known in the art of secondary and tertiary recovery of oil from subsurface formations. The produced pregnant leach solution can then be treated for the recovery of solubilized uranium values in the same manner as previously described with respect to the extraction of ground ores. Also, as previously mentioned, the regenerated leach solution can be recycled to thus further conserve the volume of leach solution used.

The concentration of alkaline lixiviant utilized in the leach solution may vary over a wide range, for example, from about 10 to about 80 grams/liter of solution or, expressed in terms of solid uranium-containing material, from about 20 to about 80 pounds per ton of solid uranium-containing material. The amount of additive utilized may vary from about 0.2 to about 1.5 percent by weight of the solution, preferably between about 0.2 and about 0.5 weight percent of the leach solution. Stated differently the additive may vary between about the stoichiometric amount required to oxidize all of the uranium in valence states lower than its hexavalent state to the hexavalent state up to about twice the stoichiometric amount. Stated in terms of the amount of solid uranium-containing material being treated, the additive may range from about 10 to about 80 pounds consumed per ton of solid material containing uranium. The amount of catalytic material to be utilized, in accordance with the present invention, may vary from about 0.02 to about 0.2 weight percent of the leach solution and, preferably, between 0.02 and 0.1 weight percent. On the basis of the amount of solid material containing uranium to be treated, the amount of catalyst may vary between about 0.1 and about 10 pounds consumed per ton, with about 2 pounds per ton generally being sufficient. The pH of the leach solution may vary from about 7.5 to as high as 10.5. However, for best results this value should be maintained between about 7.5 and 9.0.

While specific materials, quantities thereof, specific conditions of operation and specific techniques have been referred to herein, it is to be understood that such specific recitals are for purpose of illustration only and are not to be considered limiting.

I claim:

1. A method for extracting uranium values from solid materials containing uranium in valence states lower than than its hexavalent state, comprising:

contacting said solid materials containing uranium with an aqueous alkaline leach solution selected from the group consisting of solutions of ammonium carbonate, ammonium bicarbonate and mixtures thereof and containing the ionic species $NO_3^-$ in an amount sufficient to convert at least a portion of said uranium in valence states lower than its hexavalent state to its hexalvalent state.

2. A method in accordance with claim 1 wherein the ionic species $NO_3^-$ is supplied by incorporating a nitrate selected from the group consisting of sodium nitrate and ammonium nitrate in the aqueous alkaline leach solution.

3. A method in accordance with claim 1 wherein the ionic species $NO_3^-$ is supplied by incorporating ammonium nitrate in the aqueous alkaline leach solution.

4. A method in accordance with claim 1 wherein the ionic species $NO_3^-$ is supplied by incorporating in the aqueous alkaline leach solution an alkaline nitrate.

5. A method in accordance with claim 4 wherein the alkaline nitrate is sodium nitrate.

6. A method in accordance with claim 1 wherein the aqueous alkaline leach solution additionally contains at least one catalytic compound of a metal selected from the group consisting of copper, cobalt, iron, nickel, chromium and mixtures thereof, adapted to assure the presence of the ionic species $Cu^{++}$, $Co^{++}$, $Fe^{+++}$, $Ni^{++}$, $Cr^{+++}$ and mixtures thereof, respectively, during the contacting of the solid materials containing uranium with the aqueous alkaline leach solution in an amount sufficient to catalyze the oxidation of at least a portion of the uranium in valence states lower than its hexavalent state to its hexavalent state.

7. A method in accordance with claim 6 wherein the catalytic compound is a compound of copper and is adapted to assure the presence of the ionic species $Cu^{++}$.

8. A method in accordance with claim 7 wherein the ionic species, $Cu^{++}$, is supplied by incorporating in the aqueous alkaline leach solution, copper sulfate.

9. A method in accordance with claim 6 wherein the ionic species $Cu^{++}$, $Co^{+++}$, $Fe^{+++}$, $Ni^{++}$, $Cr^{+++}$ and mixtures thereof, respectively, are present during the contacting of the solid materials containing uranium with the aqueous alkaline leach solution in the form of a coordination compound.

10. A method in accordance with claim 6 wherein the ionic species $Cu^{++}$, $Co^{++}$, $Ni^{++}$, $Cr^{+++}$ and mixtures thereof, respectively, are supplied by incorporating in the aqueous alkaline leach solution a salt of the ionic species.

11. A method in accordance with claim 6 wherein the ionic species $Cu^{++}$ is supplied by incorporating in the aqueous alkaline leach solution copper sulfate.

12. A method in accordance with claim 1, 2, 3, 4, 5, 6, 7, 8, 9, 10, or 11 wherein the ionic species $NO_3^-$ is supplied by incorporating in the aqueous alkaline leach solution about 0.2 to about 0.5 weight percent of an alkaline nitrate.

13. A method in accordance with claim 1, 4 or 5 wherein the material selected from the group consisting of ammonium carbonate, ammonium bicarbonate and mixtures thereof is added to the aqueous alkaline leach solution in amounts between about 1.0 and about 10 weight percent.

14. A method in accordance with claims 1, 2, 3, 4, 5, 6, 7, 8, 9, 10 or 11 wherein the pH of the aqueous alkaline leach solution is between about 7.5 and about 10.

15. A method in accordance with claim 1, 2, 3, 4, 5, 6, 7, 8, 9, 10 or 11 in which the solid material containing uranium is a mined and ground ore and the uranium values are extracted from said ore by contacting said ore with an aqueous alkaline leach solution.

16. A method in accordance with claim 1, 2, 3, 4, 5, 6, 7, 8, 9, 10 or 11 in which the solid material containing uranium is a subsurface deposit and the uranium values are extracted from the subsurface deposit by injecting the aqueous alkaline leach solution into said deposit through at least one injection well, maintaining said aqueous alkaline leach solution in contact with the subsurface formation for a time sufficient to convert at least a part of the uranium in its valence states lower than its hexavalent state to its hexavalent state and, thereafter, producing a pregnant leach solution through at least one production well.

17. A method in accordance with claim 1, 2, 3, 4, 5, 6, 7, 8, 9, 10 or 11 in which a gaseous oxidant is present in the aqueous alkaline leach solution, as an oxidant, in addition to the alkaline nitrate.

18. A method in accordance with claim 17 wherein the gaseous oxidant is incorporated in the aqueous alkaline leach solution by exposing the aqueous alkaline leach solution to air during the contacting of the solid materials containing uranium with the aqueous alkaline leach solution.

19. A method in accordance with claim 17 wherein the gaseous oxidant is incorporated in the aqueous alkaline leach solution by exposing said aqueous alkaline leach solution to air prior to the contacting of the solid materials containing uranium with the aqueous alkaline leach solution.

* * * * *